US009455540B2

(12) United States Patent
Chen

(10) Patent No.: US 9,455,540 B2
(45) Date of Patent: Sep. 27, 2016

(54) HIGH-SPEED SIGNAL TRANSMISSION DEVICE

(71) Applicant: AIMMET INDUSTRIAL CO., LTD., Tainan (TW)

(72) Inventor: Hsiang Feng Chen, Tainan (TW)

(73) Assignee: AIMMET INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 14/599,959

(22) Filed: Jan. 19, 2015

(65) Prior Publication Data

US 2016/0211631 A1 Jul. 21, 2016

(51) Int. Cl.
*H01R 25/00* (2006.01)

(52) U.S. Cl.
CPC ..... *H01R 25/00* (2013.01)

(58) Field of Classification Search
CPC ... H01R 25/00; H01R 23/025; H01R 31/065
USPC ..... 439/638, 626
See application file for complete search history.

(56) References Cited

U.S. PATENT DOCUMENTS 4,981,438 A * 1/1991 Bekhiet ..... H02B 1/202 439/502
6,283,789 B1 * 9/2001 Tsai ..... H01R 31/005 439/502
6,719,591 B1 * 4/2004 Chang ..... H01R 27/02 439/638
8,337,242 B2 * 12/2012 Sun ..... H01R 13/74 439/499
8,535,090 B2 * 9/2013 Su ..... H01R 27/02 439/502
8,916,774 B2 * 12/2014 Richards ..... H02G 3/0487 174/70 C
9,140,859 B2 * 9/2015 Anderson ..... G02B 6/3825
2003/0008566 A1 * 1/2003 Kato ..... H01R 27/02 439/638
2004/0023552 A1 * 2/2004 Chen ..... H01B 11/02 439/502
2004/0152357 A1 * 8/2004 Sivertsen ..... H01R 31/065 439/502
2006/0079122 A1 * 4/2006 Matias ..... G06F 3/0227 439/502
2011/0034068 A1 * 2/2011 Russell ..... G02B 6/3895 439/488
2013/0084725 A1 * 4/2013 Liao ..... H01R 31/06 439/170
2014/0216781 A1 * 8/2014 Shen ..... H01R 31/06 174/102 R

FOREIGN PATENT DOCUMENTS

TW M479496 U 6/2014
TW M479497 U 6/2014

* cited by examiner

*Primary Examiner* — Tulsidas C Patel
*Assistant Examiner* — Peter G Leigh
(74) *Attorney, Agent, or Firm* — J.C. Patents

(57) ABSTRACT

This invention relates to a high-speed signal transmission device, which includes a first transmission device and a second transmission device. Said first transmission device has a first signal cable with a first plug connector and second plug connector on it both ends, said second transmission device has a second signal cable with a third plug connector and fourth plug connector on it both ends. Using a first socket connector and a third socket connector to connect said first plug connector and third plug connector, and using a second socket connector and a fourth socket connector to connect said second plug connector and fourth plug connector to connect first transmission device and a second transmission device electrically to get the signal transmission speed of USB 3.0 and to enhance the rate of signal transmission.

11 Claims, 3 Drawing Sheets

HIGH-SPEED SIGNAL TRANSMISSION DEVICE

FIELD OF THE INVENTION

The high-speed signal transmission device of present invention, particularly referring to the one by means of a combination setting of the first transmission device and the second transmission device, to connect a dual connectivity of the first socket connector and the third socket connector, and a dual connectivity of the second socket connector and the fourth socket connector respectively set at PCB ends of both-side signal source, so that the car signal transmission can reach the speed of USB3.0 to enhance the signal transmission speed.

DESCRIPTION OF RELATED ART

According to conventional technology of signal transmission cables such as Taiwan new models of No. M479496 and No. M479497, in order to promote the rate of signal transmission to the speed of USB3.0, signal cables must have nine signal cables; similarly, to set nine signal cables, should include plug connectors and socket connectors with nine terminals. At present, the transmission speed of vehicles is USB2.0, and because low transmission rate will cause the vehicle signal transmission delay, and if you want to add the external USB devices, such as audio and video equipment, information computer, all of which currently are USB3.0 system, you can only reduce the rate of transmission to the vehicle system, but cannot improve the quality of video and computer systems.

For this reason, the inventor with cumulative years of experience in the design and manufacture of related products studied the problems of aforementioned signal transmission speed of the current car for this invention.

SUMMARY OF THE INVENTION

The purpose of present invention is to provide a high-speed signal transmission device, by means of a combination setting of the first transmission device and the second transmission device, to connect the dual connectivity of the first socket connector and the second socket connector set at the PCB end of signal source, so that the car signal transmission can reach the speed of USB3.0 to enhance the signal transmission speed of car, or AV transmission, or access and transmission of computer information to the vehicle system.

In order to reach the aforementioned purpose, the present invention of the high-speed signal transmission device has a first transmission device set with the first signal cable, at both ends of which the first plug connector and the second plug connector are set respectively; and a second transmission device, which is set with the second signal cable, at both ends of which the third plug connector and the fourth plug connector are set respectively; the first plug connector corresponding to the aforementioned first transmission device, and the third plug connector corresponding to the second transmission device set with a dual connectivity of the first socket connector and the third socket connector at the PCB end of one side of signal source, and the second plug connector corresponding to the aforementioned first transmission device and the fourth plug connector corresponding to the second transmission device, set with a dual connectivity of the second socket connector and the fourth socket connector at the PCB end of the other side of signal source, so that use the combination setting of the first transmission device and the second transmission device to get the car signal transmission speed of USB3.0 and to enhance the rate of signal transmission.

The high-speed signal transmission device of present invention, among which the first plug connector and the second plug connector set at both ends of the first signal cable in the second transmission device; and the third plug connector and the fourth plug connector set at both ends of the second signal cable in the second transmission device can be replaced by socket connectors; moreover, the dual connectivity of first socket connector and the third socket connector, and the dual connectivity of the second socket connector and the fourth socket connector set at PCB end of car signal source can be replaced by plug connectors, so that the first transmission device and the second transmission device can be combined to use, corresponding to a dual connectivity of connectors inserted into the PCB end of signal source to enhance the car signal transmission to the speed of USB3.0.

The high-speed signal transmission device of present invention, among which, the first transmission device set with the first signal cable, and at both ends of which the first plug connector and the second plug connector are set respectively; the aforesaid second transmission device set with the second signal cable, and at both ends of which the third plug connector and the fourth plug connector are respectively; the first plug connector corresponding to the aforementioned first transmission device, and the third plug connector corresponding to the second transmission device set with a dual connectivity of the first socket connector and the third socket connector at the PCBs end of one side of signal source, and the second plug connector corresponding to the aforementioned first transmission device and the fourth plug connector corresponding to the second transmission device, set with the second socket connector and the fourth socket connector at the input end in the car; the aforementioned second socket connector and the fourth socket connector combine with an universal connector or other input connector to form a signal switching device, so that use the combination setting of the first transmission device and the second transmission device to get the signal transmission speed of USB3.0 and to enhance the rate of signal transmission.

DETAILED DESCRIPTION OF THE PREFERRED EMBODIMENTS

Herein below preferred the composite structure of the high-speed signal transmission device of the present invention will be described in detail with reference to the accompanying drawings.

Figure 1:
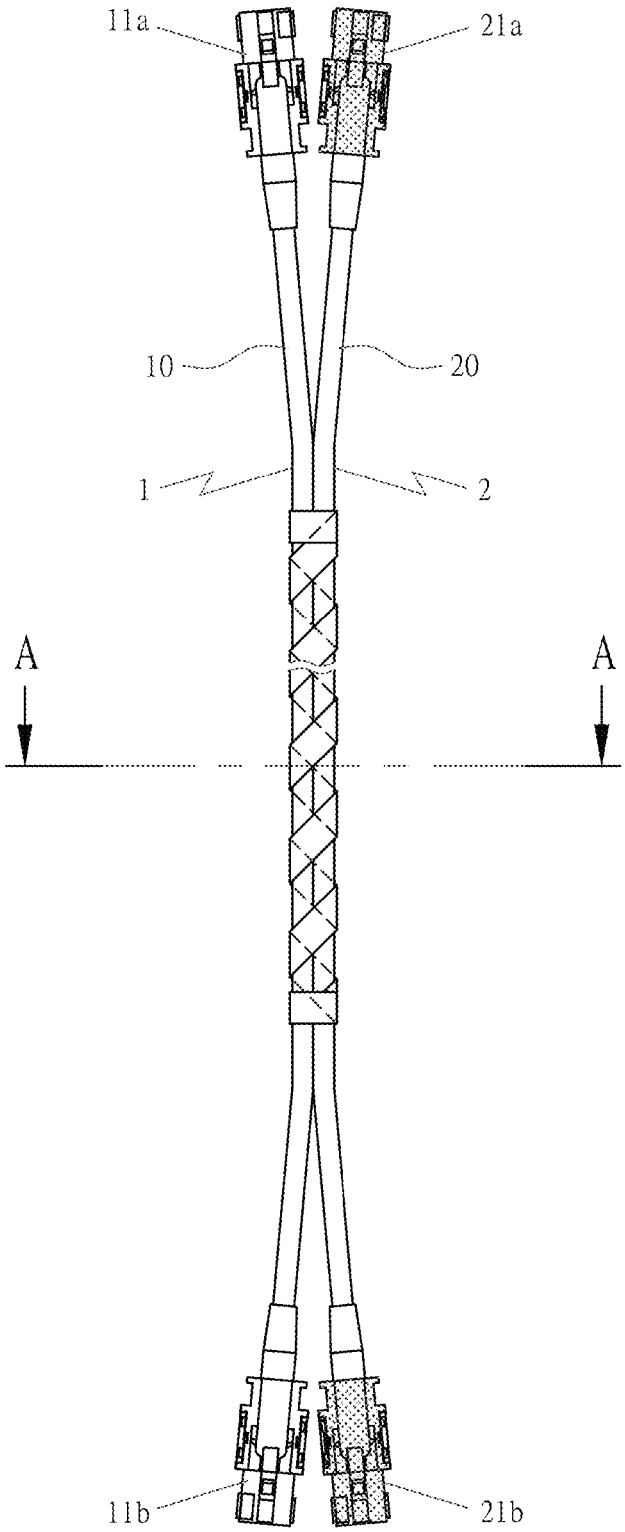
FIG. 1 is a top view of the first transmission device and the second transmission device of the present invention.
Figure 2:
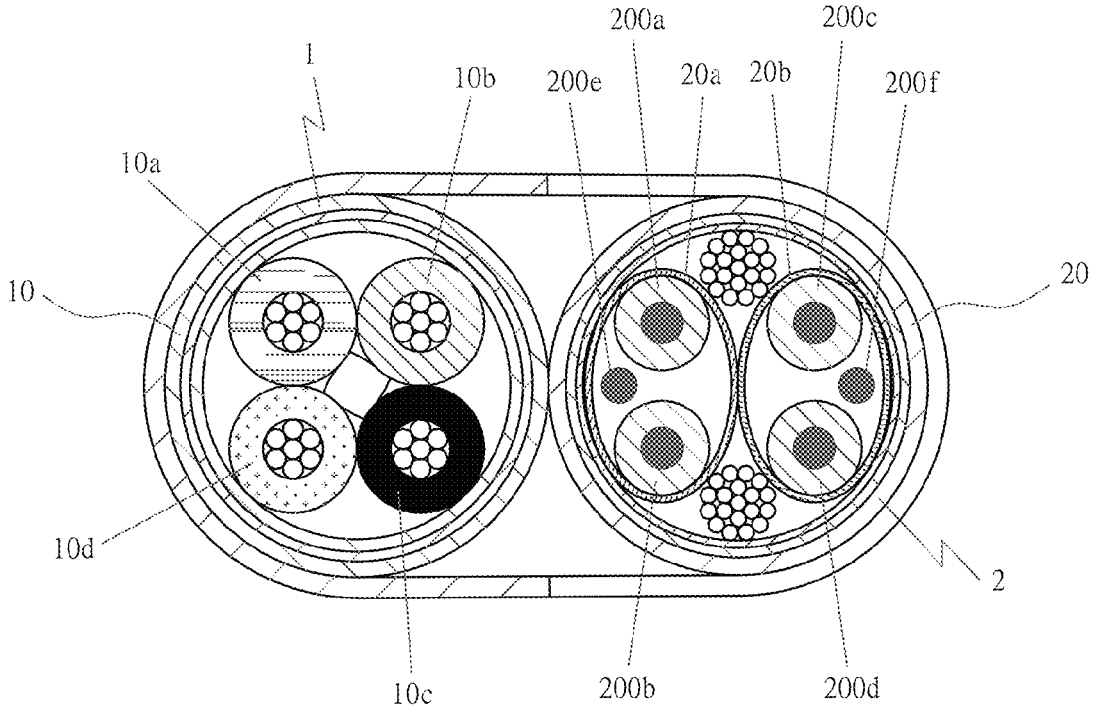
FIG. 2 is an enlarged sectional view of A-A shown in FIG. 1.

As shown in FIGS. 1 and 2, the high-speed signal transmission device of present invention includes the first transmission device 1, set with the first signal cable 10, and the first plug connector 11*a* and the second plug connector 11*b* are set at both ends of the aforementioned first signal cable 10; and four signal cables 10*a*, 10*b*, 10*c*, 10*d* are set in the aforementioned first signal cable 10, so that the first plug connector 11*a* and the second plug connector 11*b* at both ends of the first signal cable need to set four terminals only.

As shown in FIGS. 1 and 2, the high-speed signal transmission device of present invention includes the second transmission device 2, set with the second signal cable 20, and the third plug connector 21*a* and the fourth plug connector 21*b* set at both ends of aforementioned second signal cable 20, and two high speed transmission lines 20*a*, 20*b* are set in aforementioned second signal cable 20; aforementioned high speed transmission lines 20*a*, 20*b* set with two signal cables 200*a*, 200*b* and 200*c*, 200*d*, and one ground wire 200*e*, and 200*f* respectively to form two sets of cables, so that the third plug connector 21*a* and the fourth plug connector 21*b* at both ends of the second signal cable need to set four terminals only.

Figure 3:
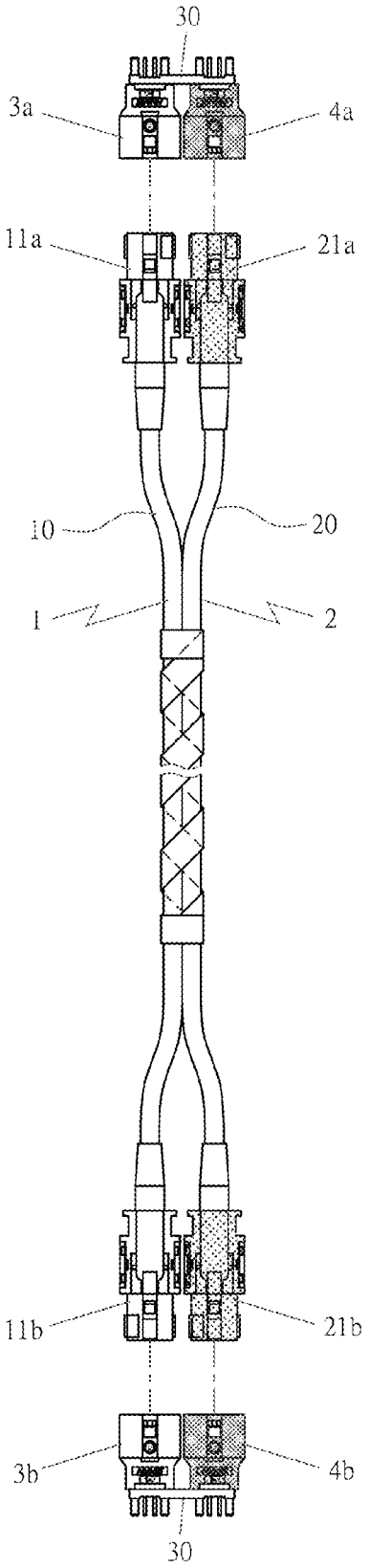
FIG. 3 is a state diagram stating the transmission device and signal source connector in embodiment example 1 of the present invention, before connecting.

With regard to FIG. 3, the embodiment example 1 of the present invention, the first plug connector 11*a* corresponding to aforementioned first transmission device 1, and the third plug connector 21*a* corresponding to the second transmission device 2 set with a dual connectivity of the first socket connector 3*a* and the third socket connector 4*a* at the PCB end of signal source; the aforementioned dual connectivity of the first socket connector 3*a* and the third socket connector 4*a* of is by means of a coupling member 30 to combine the two into one, and is distinguished by color, so that users or installers/builders can quickly insert for connection, and maintain four terminals respectively for the first socket connector 3*a* and the third socket connector 4*a*, to match the terminal operation of the first plug connectors 11*a*, 11*b* of aforementioned first transmission device 1, and the second plug connectors 21*a*, 21*b* of the second transmission device 2. The second plug connector 11*b* corresponding to the aforementioned first transmission device 1, and the fourth plug connector 21*b* corresponding to the second transmission device 2, set with a dual connectivity for the second socket connector 3*b* and the fourth socket connector 4*b* at the PCB end of signal source; aforementioned dual connectivity of the second socket connector 3*b* and the fourth socket connector 4*b* is by means of a coupling member 30 to combine the two into one, and distinguished by color, so that users or installers/builders can quickly insert for connection, and maintain four terminals respectively for the second socket connector 3*b* and the fourth socket connector 4*b*, to match the terminal operation of the second plug connector 11*b* of aforementioned first transmission device 1, and the fourth plug connector 21*b* of the second transmission device 2, so that by means of the combination setting of the first transmission device and the second transmission device, the signal transmission will reach the speed of USB3.0 to enhance the effect of signal transmission.

Figure 4:
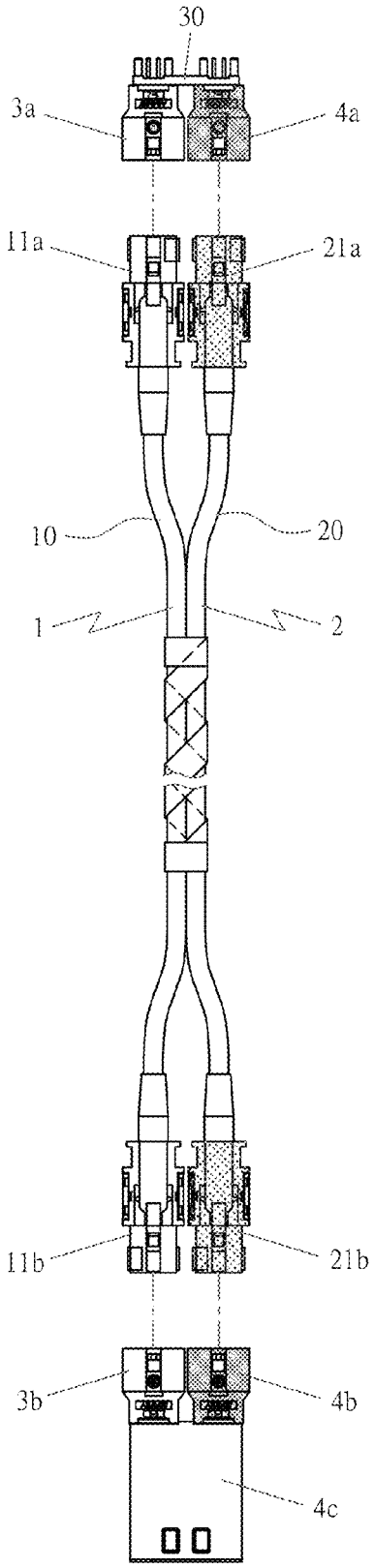
FIG. 4 is a state diagram stating the transmission device and signal source connector in embodiment example 2 of the present invention, before connecting.

With regard to FIG. 4, the embodiment example 2 of the present invention; the first plug connector 11*a* corresponding to aforementioned first transmission device 1, and the third plug connector 21*a* corresponding to the second transmission device 2 set with a dual connectivity of the first socket connector 3*a* and the third socket connector 4*a* at the PCB end of signal source; the aforementioned dual connectivity of the first socket connector 3*a* and the third socket connector 4*a* is by means of a coupling member 30 to combine the two into one, and is distinguished by color, so that users or installers/builders can quickly insert for connection, and maintain four terminals respectively for the first socket connector 3*a* and the third socket connector 4*a*, to match the terminal operation of the first plug connectors 11*a*, 11*b* of aforementioned first transmission device 1, and the second plug connectors 21*a*, 21*b* of the second transmission device 2. The second plug connector 11*b* corresponding to aforementioned first transmission device 1, and the fourth plug connector 21*b* corresponding to the second transmission device 2, set with a dual connectivity for the second socket connector 3*b* and the fourth socket connector 4*b* at the input end in the car; the aforementioned dual connectivity of the second socket connector 3*b* and the fourth socket connector 4*b* is by means of a coupling member 30 to combine the two into one, and distinguished by color, so that users or installers/builders can quickly insert for connection, and maintain four terminal respectively for the second socket connector 3*b* and the fourth socket connector 4*b*, and combine with an universal connector or other signal transmission connector in a car to insert the USB AV device, or computer device, or USB data transmission equipment for connection, so that the display device or playing device can play the AV content; use the combination setting of the first transmission device and the second transmission device to get the signal transmission speed of USB3.0 and to enhance the rate of signal transmission.

The high-speed signal transmission device of present invention, among which the first plug connector and the second plug connector of the first transmission device, and the third plug connector and the fourth plug connector of the second transmission device can be replaced by socket connectors, and the first socket connector and the third socket connector set at the PCB end of signal source, and the second socket connector and the fourth socket connector set at input ends in the car can be replaced by plug connectors to match the use demand, as long as the first transmission device and the second transmission device can be combined to use, and corresponding to the connectors set at the PCB end of signal source or the input end in the car. Therefore, in the present invention, the first plug connector and the second plug connector set in the first transmission device, the third plug connector and the fourth plug connector set in the second transmission device, the dual connectivity of the first socket connector and the third socket connector set at one end of signal source, and the dual connectivity of the second socket connector and the fourth socket connector set at the other end of signal source; or the second socket connector and the fourth socket connector set at the input end in the car are not limited to the definition of their names, but can be changed in operation subject to actual needs.

Therefore, the present invention, by means of the combination setting of the first transmission device and the second transmission device to match the connectors set at the PCB end of signal source, or the input end in the car, can enhance the car signal transmission to the speed of USB3.0, and strengthen the effect of signal transmission; apparently, the present invention actually is practical and progressive.

DESCRIPTION OF SYMBOLS

The first transmission device 1, the first signal cable 10, the first plug connector 11*a*, the second plug connector 11*b*, signal cables 10*a*, 10*b*, 10*c*, 10*d*, the second transmission device 2, the second signal cable 20, the third plug connector 21*a*, the fourth plug connector 21*b*, high speed transmission line sets 20*a*, 20*b*, signal cables 200*a*, 200*b*, 200*c*, 200*d*, ground wire 200*e*, 200*f*, the first socket connector 3*a*, the second socket connector 3*b*, the third socket connector 4*a*, the fourth socket connector 4*b*, universal connector 4*c*, coupling member 30

What is claimed is:

1. A high-speed signal transmission device for use in vehicles, comprising: a first transmission device set with a first signal cable, and at both ends of which a first plug connector and a second plug connector are set; a second transmission device set with a second signal cable, and at both ends of which a third plug connector and a fourth plug connector are set; the first plug connector corresponding to the first transmission device, and the third plug connector corresponding to the second transmission device are set with a dual connectivity of a first socket connector and a third socket connector at a PCB end of one side of a signal source, and the second plug connector corresponding to the first transmission device and the fourth plug connector corresponding to the second transmission device are set with a dual connectivity of a second socket connector and a fourth socket connector at a PCB end of the other side of the signal source, so as to use the combination setting of the first transmission device and the second transmission device to get the signal transmission speed of USB3.0 and to enhance the rate of signal transmission;

wherein the first socket connector and the third socket connector are combined into one with a first coupling member and installed in a vehicle, the second socket connector and the fourth socket connector are combined into one with a second coupling member and installed in the vehicle;

wherein four signal cables are set in the first signal cable of the first transmission device, so that the first plug connector and the second plug connector set in both ends of the first signal cable need four terminals only;

wherein two high speed transmission lines are set in the second signal cable of the second transmission device; the high speed transmission lines have two signal cables and one ground wire to form two sets of cables, so that the third plug connector and the fourth plug connector set in both ends of the second signal cable need four terminals only.

2. The high-speed signal transmission device according to claim 1, wherein the first signal cable consists of only four signal cables, the second signal cable consists of only two high speed transmission lines, each of the high speed transmission lines consists of two signal cables and one ground wire.

3. The high-speed signal transmission device according to claim 1, wherein the third plug connector and the fourth plug connector set in both ends of the second signal cable each has four terminals only.

4. The high-speed signal transmission device according to claim 1, wherein a dual connectivity of the first socket connector and the third socket connector set at the PCB end of one side of signal source of the first plug connector corresponding to the first transmission device, and of the third plug connector corresponding to the second transmission device, is combined together by a coupling member and distinguished by color; and four terminals are set at the first socket connector and the third socket connector respectively to match the operation of terminals at the first plug connector of the first transmission device and at the third plug connector of the second transmission device.

5. The high-speed signal transmission device according to claim 1, wherein a dual connectivity of the second socket connector and the fourth socket connector set at the PCB ends of one side of signal source of the second plug connector corresponding to the first transmission device, and of the fourth plug connector corresponding to the second transmission device, is combined together by a coupling member and distinguished by color; and four sets of terminals are set at the second socket connector and the fourth socket connector respectively to match the operation of terminals respectively at the second plug connector of the first transmission device and at the fourth plug connector of the second transmission device.

6. The high-speed signal transmission device according to claim 1, wherein the first plug connector and the second plug connector of the first transmission device, and third plug connector and the fourth plug connector of the second transmission device can be replaced by socket connectors, and the first socket connector and the third socket connector, as well as the second socket connector and the fourth socket connector set in the PCB end of signal source can be replaced by plug connectors to match the use demand.

7. A high-speed signal transmission device for use in vehicles, comprising: a first transmission device set with a first signal cable, and at both ends of which a first plug connector and a second plug connector are set; a second transmission device set with a second signal cable, and at both ends of which a third plug connector and a fourth plug connector are set; the first plug connector corresponding to the first transmission device, and the third plug connector corresponding to the second transmission device are set with a dual connectivity of a first socket connector and a third socket connector at a PCB end of one side of signal source, and the second plug connector corresponding to the first transmission device and the fourth plug connector corresponding to the second transmission device are set with a second socket connector and a fourth socket connector at an input end in a vehicle; the second socket connector and the fourth socket connector combined with an universal connector or other input connector to form a signal switching device, so as to use the combination setting of the first transmission device and the second transmission device to get the signal transmission speed of USB3.0 and to enhance the rate of signal transmission;

wherein the first socket connector and the third socket connector are combined into one with a first coupling member and installed in the vehicle;

wherein four signal cables are set in the first signal cable of the first transmission device, so that the first plug connector and the second plug connector set at two ends of the first signal cable need four sets of terminals only;

wherein two high speed transmission line are set in the second signal cable of the second transmission device; the high speed transmission line have two signal cables and one ground wire to form two sets of cables, so that the third plug connector and the fourth plug connector set in both ends of the second signal cable need four sets of terminals only.

8. The high-speed signal transmission device according to claim 7, wherein the dual connectivity of the first socket connector and the third socket connector set at a PCB end of one side of signal source of the first plug connector corresponding to the first transmission device, and of the third plug connector corresponding to the second transmission device, is combined together by a coupling member and distinguished by color; and four terminals are set respectively at the first socket connector and the third socket connector to match the operation of terminals at the first plug connector of the first transmission device and at the third plug connector of the second transmission device.

9. The high-speed signal transmission device according to claim 7, wherein the first plug connector and the second plug connector of the first transmission device, and the third plug connector and the fourth plug connector of the second transmission device can be replaced by socket connectors, and the first socket connector and the third socket connector set in the PCB end of signal source, and the second socket connector and the fourth socket connector set at the input end in the vehicle can be replaced by plug connectors to match the use demand.

10. The high-speed signal transmission device according to claim 7, wherein the first signal cable consists of only four signal cables, the second signal cable consists of only two high speed transmission lines, each of the high speed transmission lines consists of two signal cables and one ground wire.

11. The high-speed signal transmission device according to claim 7, wherein the third plug connector and the fourth plug connector set in both ends of the second signal cable each has four terminals only.

* * * * *